US010396486B2

(12) United States Patent
de Chazal et al.

(10) Patent No.: US 10,396,486 B2
(45) Date of Patent: Aug. 27, 2019

(54) ELECTRICAL CONNECTOR WITH TERMINAL POSITION ASSURANCE MEMBER

(71) Applicants: TE CONNECTIVITY CORPORATION, Berwyn, PA (US); TE CONNECTIVITY INDIA PRIVATE LIMITED, Bangalore (IN)

(72) Inventors: Aaron James de Chazal, Rochester, MI (US); Gajanan Bhat, Bangalore (IN); Tejus Kiran Salaka, Bengaluru (IN)

(73) Assignees: TE CONNECTIVITY INDIA PRIVATE LIMITED, Bangalore (IN); TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/984,824

(22) Filed: May 21, 2018

(65) Prior Publication Data

US 2019/0173221 A1 Jun. 6, 2019

(30) Foreign Application Priority Data

Dec. 1, 2017 (IN) ..... 2017/11043177

(51) Int. Cl.
*H01R 13/436* (2006.01)
*H01R 13/631* (2006.01)
(Continued)

(52) U.S. Cl.
CPC ..... *H01R 13/4365* (2013.01); *H01R 13/4362* (2013.01); *H01R 13/4368* (2013.01);
(Continued)

(58) Field of Classification Search
CPC ..... H01R 13/4365; H01R 13/4362; H01R 13/631; H01R 13/642
(Continued)

(56) References Cited

U.S. PATENT DOCUMENTS 5,851,128 A * 12/1998 Nakata ..... H01R 13/4223 439/752
5,941,737 A 8/1999 Sakai et al.
(Continued)

FOREIGN PATENT DOCUMENTS

EP 0503947 A2 9/1992
EP 0518361 A2 12/1992
(Continued)

OTHER PUBLICATIONS

International Search Report, International Application No. PCT/IB2018/058882, International Filing Date, Nov. 12, 2018.

*Primary Examiner* — Alexander Gilman

(57) ABSTRACT

An electrical connector includes a housing and a terminal position assurance (TPA) member. The housing defines multiple cavities that extend between mating and cable ends of the housing, and are oriented parallel to a cavity axis. The housing holds electrical terminals within the cavities for electrically connecting to mating contacts of a mating connector. The TPA member is mounted to the cable end of the housing and movable relative to the housing between an unlocked position and a locked position. The TPA member moves from the unlocked position to the locked position along an actuation axis that is perpendicular to the cavity axis. The TPA member includes ledges that protrude into the cavities of the housing and into corresponding retreat paths of the terminals when the TPA member is in the locked position to block retreat of the terminals towards the cable end of the housing.

18 Claims, 9 Drawing Sheets

(51) Int. Cl.

| | |
|---|---|
| ***H01R 13/642*** | (2006.01) |
| *H01R 13/422* | (2006.01) |
| *H01R 13/432* | (2006.01) |
| *H01R 13/52* | (2006.01) |
| *H01R 13/74* | (2006.01) |

(52) U.S. Cl.
CPC ..... *H01R 13/631* (2013.01); *H01R 13/642* (2013.01); *H01R 13/4223* (2013.01); *H01R 13/432* (2013.01); *H01R 13/5202* (2013.01); *H01R 13/748* (2013.01)

(58) Field of Classification Search
USPC ..... 439/752

See application file for complete search history.

(56) References Cited

U.S. PATENT DOCUMENTS

| | | | | |
|---|---|---|---|---|
| 7,048,581 | B1 * | 5/2006 | Wong | H01R 13/426 439/595 |
| 7,261,603 | B2 * | 8/2007 | Takahashi | H01R 13/4361 439/595 |
| 8,979,599 | B2 * | 3/2015 | Hautbois | H01R 13/4362 439/752 |
| 9,039,462 | B2 * | 5/2015 | Yoon | H01R 13/4365 439/752 |
| 9,413,099 | B2 * | 8/2016 | Vanslambrouck | H01R 4/12 |
| 9,590,348 | B2 * | 3/2017 | Grudzewski | H01R 13/5202 |
| 2009/0186523 | A1 | 7/2009 | Campbell et al. | |

FOREIGN PATENT DOCUMENTS

| | | | |
|---|---|---|---|
| EP | 2525443 | A1 | 11/2012 |
| FR | 3017002 | A1 | 7/2015 |
| WO | 2013178773 | A1 | 12/2013 |

* cited by examiner

ELECTRICAL CONNECTOR WITH TERMINAL POSITION ASSURANCE MEMBER

CROSS-REFERENCE TO RELATED APPLICATIONS

This application claims priority to India Patent Application No. 2017/11043177, which was filed Dec. 1, 2017 and is titled Electrical Connector With Terminal Position Assurance Member. The subject matter of which is herein incorporated by reference in its entirety.

BACKGROUND OF THE INVENTION

The subject matter herein relates generally to electrical connectors that have terminal position assurance devices or members to ensure that electrical terminals are properly loaded and secured within connector housings.

Electrical connectors typically include electrical terminals that are held within an insulative housing. The electrical terminals have to be properly positioned or seated within the housing in order to successfully mate to a corresponding electrical contact of a mating connector. If one or more of the terminals are not properly positioned, the connector may not operate as intended when mated to the mating connector. It also may be difficult to determine which of the terminals is at fault due to the number of terminals in the housing and poor accessibility of the terminals within the housing.

Another concern with electrical connectors is retention of the terminals. For example, some terminals are retained within a cavity of the housing via small retention features, such as latches, that extend between the terminal and the housing within the cavity. However, the retention features may not be sufficiently robust to withstand pulling forces exerted on cables attached to the terminals, causing the retention features to fail and allowing the terminals to be pulled out of position.

For these reasons, some electrical connectors include terminal position assurance (TPA) devices that are configured to ensure that the terminals are properly loaded within the housing and may also support retention of the terminals within the housing. However, known TPA devices have several disadvantages. For example, some TPA devices are loaded axially in-line with the terminals, extending into the cavities through either the mating end or the cable end. But, these end-loading TPA devices may not be sufficiently robust to withstand the axial pushing and/or pulling forces exerted on the terminals. Another type of TPA device is side-actuating such that the TPA device moves perpendicular to an axis of the terminals into the cavities to provide hard stop surfaces that block axial movement of the terminals. The side-actuating TPA devices may be more robust than the in-line TPA devices, but the side actuating TPA devices may not be usable due to interference with other features of the connectors, such as mounting flanges, seals, mating latches or other fasteners, or the like. For example, if the housing is surrounded by a gasket or another compressible seal, then the side-actuating movement of the TPA device may interfere with the gasket.

A need remains for an electrical connector having a TPA device that ensures the terminals are properly positioned in the housing, provides robust retention support to the terminals, and also does not interfere with other features of the connector.

BRIEF DESCRIPTION OF THE INVENTION

In one or more embodiments of the present disclosure, an electrical connector is provided that includes a housing and a terminal position assurance (TPA) member. The housing has a mating end and a cable end. The housing defines multiple cavities extending between the mating and cable ends that are oriented parallel to a cavity axis. The housing holds electrical terminals within the cavities for electrically connecting to mating contacts of a mating connector. The TPA member is mounted to the cable end of the housing and movable relative to the housing between an unlocked position and a locked position. The TPA member moves from the unlocked position to the locked position along an actuation axis that is perpendicular to the cavity axis. The TPA member includes ledges that protrude into the cavities of the housing and into corresponding retreat paths of the terminals when the TPA member is in the locked position to block retreat of the terminals towards the cable end of the housing.

In one or more embodiments of the present disclosure, an electrical connector is provided that includes a housing and a terminal position assurance (TPA) member. The housing has a mating end and a cable end. The housing defines multiple cavities extending between the mating and cable ends. The housing holds electrical terminals within the cavities for electrically connecting to mating contacts of a mating connector. The TPA member is mounted to the cable end of the housing and movable relative to the housing between an unlocked position and a locked position. The TPA member includes ledges that protrude into the cavities of the housing and into corresponding retreat paths of the terminals when the TPA member is in the locked position to block retreat of the terminals towards the cable end of the housing. Each of the cavities includes a respective hybrid cavity segment that extends from the cable end of the housing towards the mating end. The housing defines a portion of a perimeter of the hybrid cavity segment, and the TPA member defines a remaining portion of the perimeter of the hybrid cavity segment. The movement of the TPA member between the unlocked and locked positions alters a cross-sectional area of the hybrid cavity segment of each of the cavities.

In one or more embodiments of the present disclosure, an electrical connector is provided that includes a housing and a terminal position assurance (TPA) member. The housing includes a main body and a mounting flange configured for mounting the housing through an opening in a panel. The main body extends linearly between a mating end of the housing and a cable end of the housing. The main body defines multiple cavities between the mating and cable ends that are oriented parallel to a cavity axis. The housing holds electrical terminals within the cavities for electrically connecting to mating contacts of a mating connector. The mounting flange projects radially from the main body. The mounting flange is disposed between and spaced apart from the mating end and the cable end. The TPA member is mounted to the cable end of the housing. The TPA member is movable relative to the housing between an unlocked position and a locked position along an actuation axis that is perpendicular to the cavity axis. The TPA member includes ledges that protrude into the cavities of the housing and into corresponding retreat paths of the terminals when the TPA member is in the locked position to block retreat of the terminals towards the cable end of the housing.

DETAILED DESCRIPTION OF THE INVENTION

Figure 1:
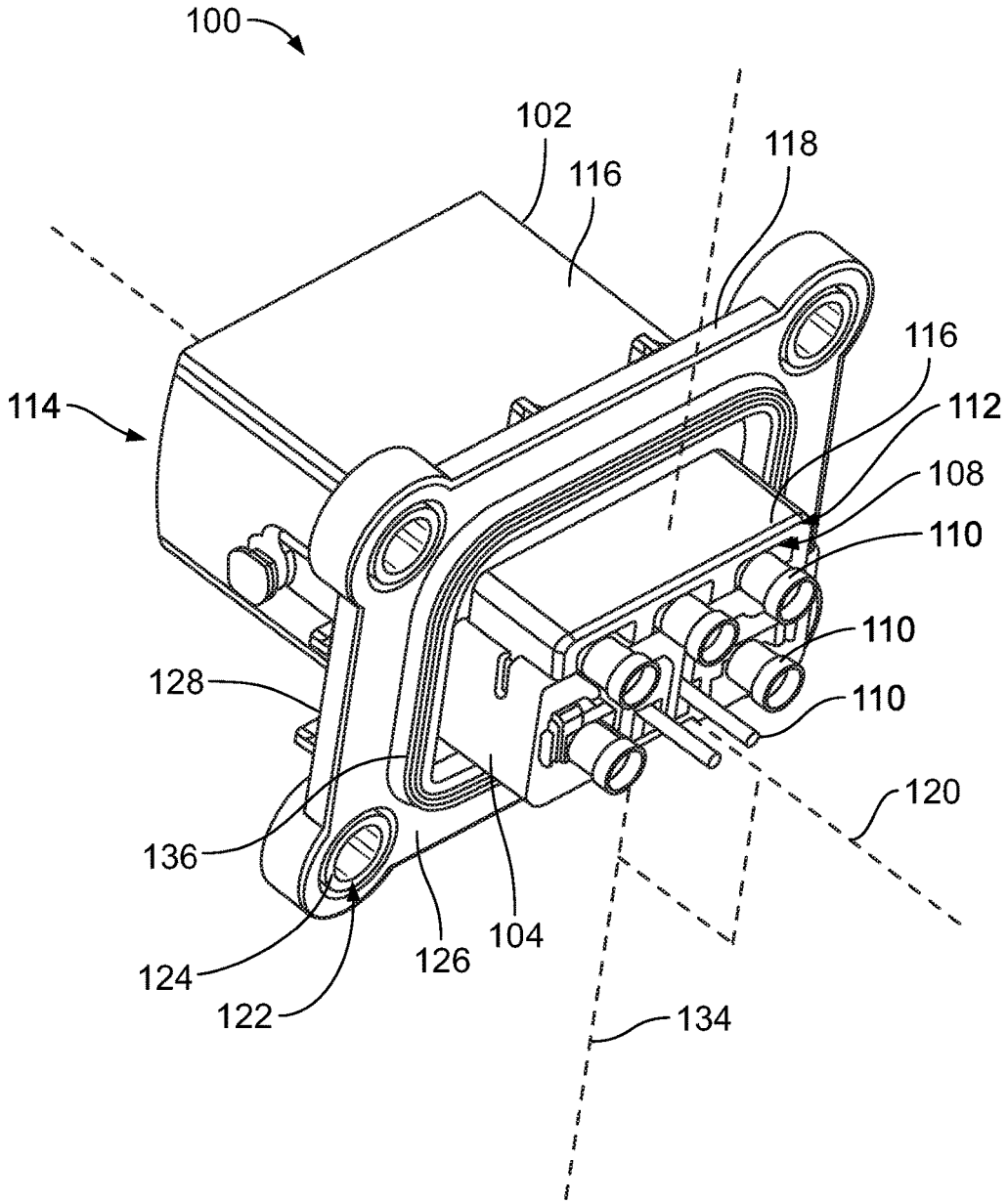
FIG. 1 is a perspective view of an electrical connector in accordance with an embodiment.
Figure 2:
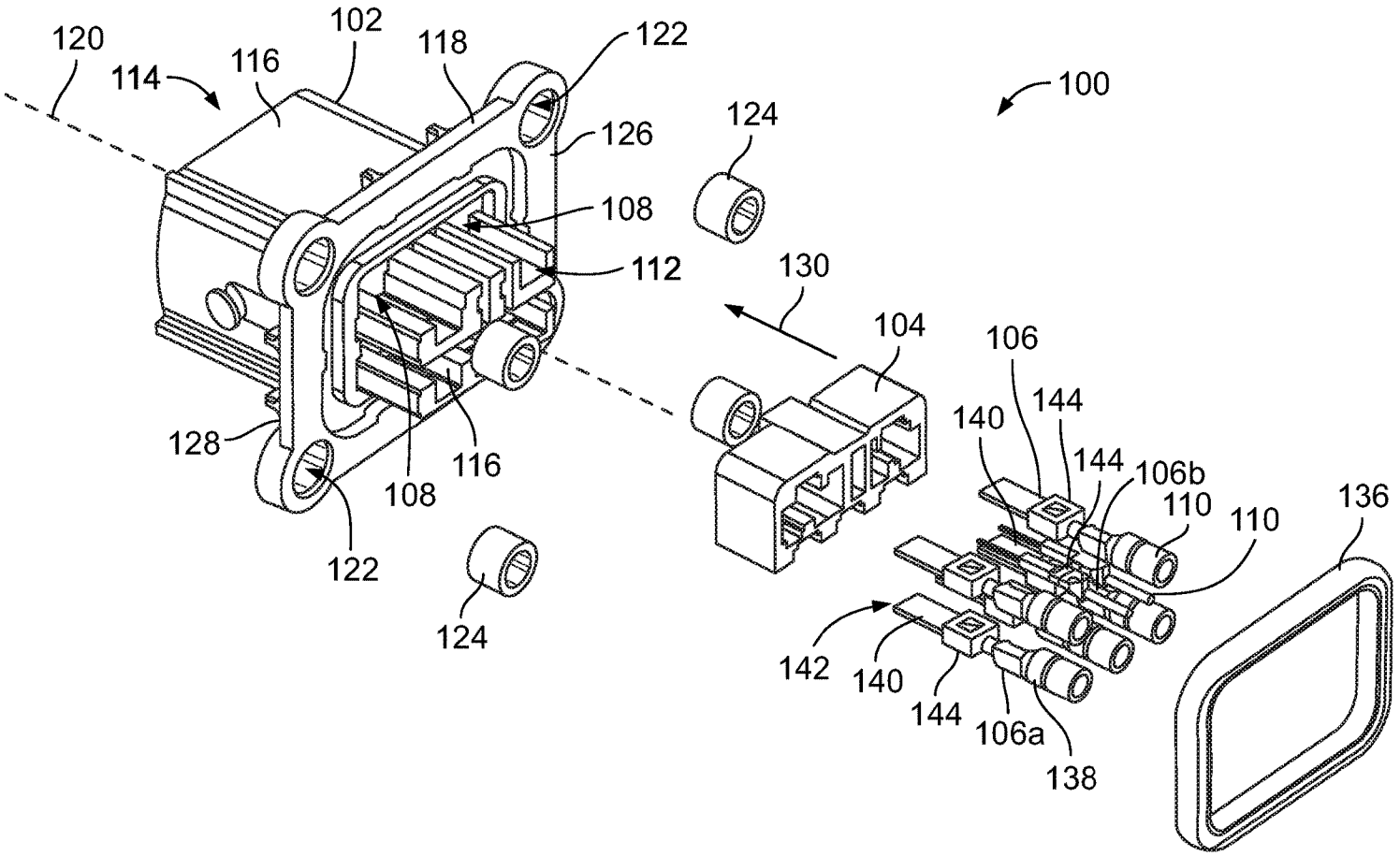
FIG. 2 is an exploded perspective view of the electrical connector according to an embodiment.

FIG. 1 is a perspective view of an electrical connector 100 in accordance with an embodiment. FIG. 2 is an exploded perspective view of the electrical connector 100 according to an embodiment. The electrical connector 100 includes a housing 102, a terminal position assurance (TPA) member 104, and multiple terminals 106 (shown in FIG. 2). The terminals 106 are held within corresponding cavities 108 of the housing 102. The terminals 106 may be electrically connected and mechanically secured to individual cables 110 that protrude from the housing 102 at a cable end 112 of the housing 102. Only short segments of the cables 110 are shown in FIGS. 1 and 2, but the cables 110 may extend to a connecting device, such as a battery, a computer, or the like.

In the illustrated embodiment, the housing 102 has the cable end 112 and a mating end 114. The mating end 114 defines a mating interface for engaging a mating connector (not shown) during a mating operation. Although not shown, the mating end 114 of the housing 102 may define a socket that receives a portion of the mating connector therein during the mating operation. The cavities 108 are open at the cable end 112 and extend towards the mating end 114. For example, the terminals 106 may be loaded into the cavities 108 through the cable end 112. The cavities 108 are fluidly connected (e.g., open) to the mating end 114, either directly or via the socket. Each terminal 106 is loaded into a different one of the cavities 108. The terminals 106 within the housing 102 are configured for electrically connecting to corresponding mating contacts of the mating connector. In an embodiment, the cavities 108 are oriented parallel to one another and parallel to a cavity axis 120.

In FIG. 1, the electrical connector 100 is an in-line or straight connector, such that the housing 102 extends linearly from the cable end 112 to the mating end 114. The housing 102 may be elongated parallel to the cavity axis 120. In an alternative embodiment, the electrical connector 100 may be other than an in-line connector, such as a right angle connector where the mating end 114 is oriented transverse to the cable end 112.

The electrical connector 100 optionally is a receptacle header connector that is mounted directly to a device, such as a chassis, battery case, or the like, of a vehicle, and is configured to mate with a plug connector. For example, the housing 102 in the illustrated embodiment includes a main body (portion) 116 and a mounting flange 118 connected to the main body 116. The mounting flange 118 is configured to be mechanically fastened to a wall or panel (not shown) to mount the connector 100 through an opening in the panel. In the illustrated embodiment, the main body 116 defines both the cable end 112 and the mating end 114. The cavities 108 extend within the main body 116. The mounting flange 118 is located between the cable and mating ends 112, 114, and is spaced apart from both of the ends 112, 114. The mounting flange 118 projects radially outward from the main body 116.

The mounting flange 118 has a first side 126 that faces the cable end 112 and an opposite, second side 128 that faces the mating end 114. The mounting flange 118 optionally defines openings 122 therethrough for receiving fasteners (not shown), such as bolts and/or screws. The openings 122 may also hold compression limiters 124 or other bearings that extend between the fasteners and the flange 118 to protect the material of the flange 118.

Optionally, the mounting flange 118 may be configured to seal against the panel or wall. The mounting flange 118 may include a compression seal 136 that is mounted to the first side 126 of the flange 118. The compression seal 136 may include a rubber or rubber-like material that compresses when sandwiched between the first side 126 of the flange 118 and the panel to prevent debris and contaminants from passing through the interface the panel and the connector 100. The compression seal 136 in the illustrated embodiment is a hollow band that extends circumferentially around the main body 116 of the housing 102 and the TPA member 104, as shown in FIG. 1. The compression seal 136 may be a gasket, an O-ring, or the like.

As shown in FIG. 1, the TPA member 104 mounts to the housing 102 at, or proximate to, the cable end 112. As described in more detail herein, the TPA member 104 is movable relative to the housing 102 between an unlocked position and a locked position. For example, during assembly, the TPA member 104 may be disposed in the unlocked position. Once the terminals 106 are loaded within the cavities 108, an operator may actuate the TPA member 104 to the locked position. In the locked position, the TPA member 104 is configured to protrude into the cavities 108 to support retention of the terminals 106 in the housing 102. For example, the TPA member 104 includes features that lock the terminals 106 in a fixed position relative to the housing 102 by blocking the terminals 106 from retreating through the cable end 112 of the housing 102. The TPA member 104 may provide a secondary means of retaining the terminals 106 in the housing 102, or, alternatively, may provide a primary and/or sole means of retaining the terminals 106 in the housing 102.

The TPA member 104 also provides terminal position assurance to indicate if any of the terminals 106 are not properly positioned within the housing 102. For example, if one or more of the terminals 106 are not fully loaded within the corresponding cavity 108, the TPA member 104 is obstructed from moving to the locked position, which provides a tactile and visual indication to the operator. The TPA member 104 may include an electrically insulative (e.g., dielectric) material, such as one or more plastics. Alternatively, the TPA member 104 may include one or more metals. The TPA member 104 may be formed by a molding process.

In one or more embodiments described herein, the TPA member 104 is configured to load onto the cable end 112 of the housing 102 in a loading direction 130 that is parallel to the cavity axis 120. The TPA member 104 is configured to load to the unlocked position. Furthermore, the TPA member 104 is configured to be actuated between the unlocked and locked positions along an actuation axis 134 (shown in FIG. 1) that is perpendicular to the loading direction 130 and the cavity axis 120. Thus, the TPA member 104 loads onto the housing 102 parallel to the cavity axis 120, and moves perpendicular to the cavity axis 120 between the unlocked and locked positions.

Referring to FIG. 2, the terminals 106 of the electrical connector 100 each have a crimp barrel 138 and a mating contact 140. The crimp barrels 138 are crimped onto the respective cables 110. The mating contacts 140 define distal ends 142 of the terminals 106 that are closest to the mating end 114 of the housing 102 when loaded into the cavities 108. In the illustrated embodiment, the electrical connector 100 includes both power terminals 106*a* and signal terminals 106*b*. The mating contacts 140 of the power terminals 106*a* are blade contacts, and the mating contacts 140 of the signal terminals 106*b* are pin contacts. In alternative embodiments, the electrical connector 100 may include only one type of terminal, such as only the signal terminals 106*b* or only the power terminals 106*a*, and/or the terminals 106 may have different types of mating contacts 140, such as socket-style contacts or deflectable beam-style contacts. In the illustrated embodiment, the terminals 106 also include shrouds 144 mounted onto the terminals 106. The shrouds 144 are mounted either to the mating contacts 140 or between the mating contacts 140 and the crimp barrels 138. The shrouds 144 are spaced apart from the distal ends 142 of the terminals 106.

The electrical connector 100 may be used in various different applications, such as with vehicles, appliances, industrial machinery, and the like. In one non-limiting example, the electrical connector 100 may be installed within an electric vehicle. For example, the electrical connector 100 may represent part of, or connect to, a charger inlet harness of the vehicle that is used to charge a battery of the vehicle.

Figure 3A:
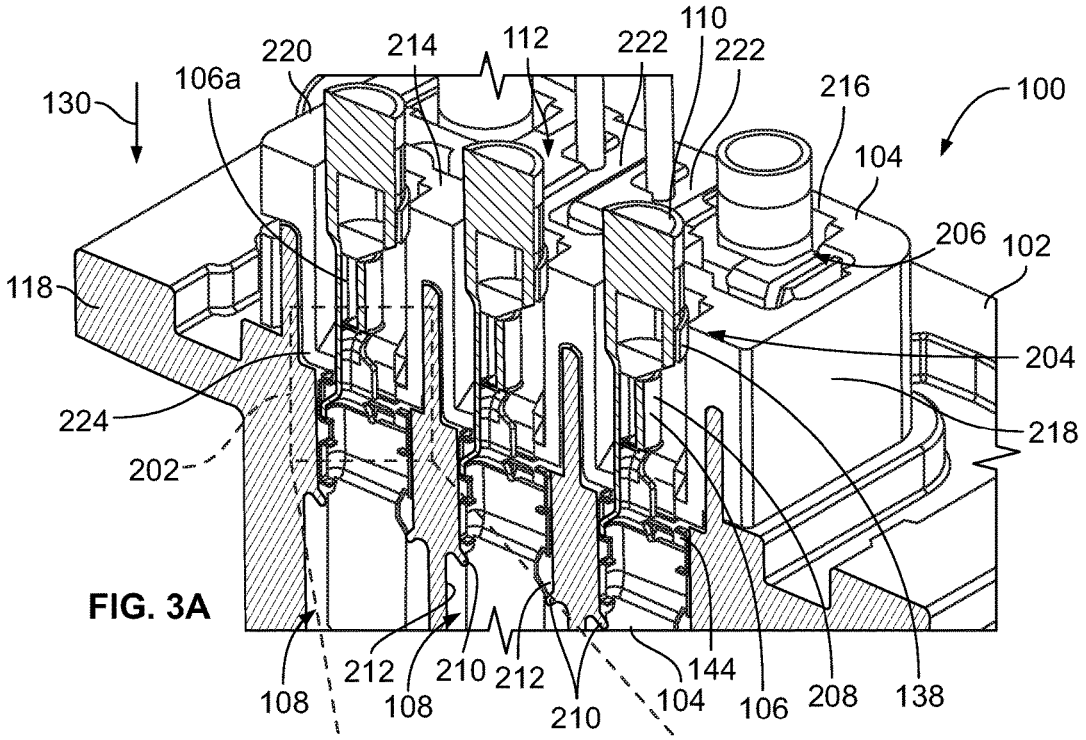
FIG. 3A is a perspective view of a portion of the electrical connector according to an embodiment showing a housing of the electrical connector and some power terminals in cross-section.
Figure 3B:
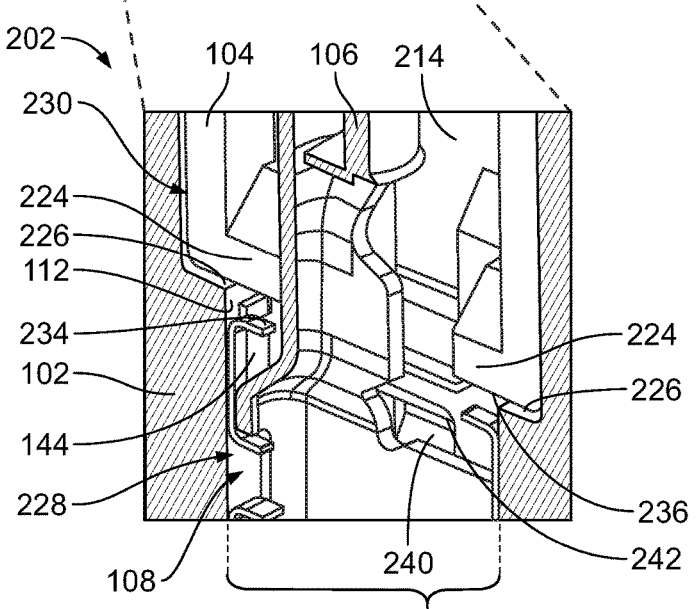
FIG. 3B is an enlarged view of a sub-section of the electrical connector shown in FIG. 3A.

FIG. 3A is a perspective view of a portion of the electrical connector 100 according to an embodiment showing the housing 102 and some of the power terminals 106*a* in cross-section. FIG. 3B is an enlarged view of a sub-section 202 of the electrical connector 100 shown in FIG. 3A. The TPA member 104 is in the locked position relative to the housing 102 in FIGS. 3A and 3B. The cross-section line does not extend through the TPA member 104 in the illustrated embodiment.

In an embodiment, the terminals 106 are held in the connector 100 in two rows 204, 206. The cross-section line extends through the terminals 106 and cables 110 in the first row 204, as well as the cavities 108 of the housing 102 that receive the first row 204 of terminals 106. The terminals 106 are positioned in the cavities 108 such that the crimp barrels 138 and intermediate segments 208 of the terminals 106 align generally with the TPA member 104, and the mating contacts 140 and shrouds 144 are disposed beyond the TPA member 104 within the cavities 108. Optionally, the shrouds 144 may align with the mounting flange 118 of the housing 102. The housing 102 may include one or more protrusions 210 that extend from interior walls 212 of the housing 102 into the cavities 108. The protrusions 210 engage the shrouds 144, or another part of the terminals 106, to block additional movement of the terminals 106 in the loading direction 130. For example, each terminal 106 may attain a fully loaded or fully seated position within the housing 102 when the proper component of the terminal 106 (e.g., the shroud 144) abuts against the one or more protrusions 210 in the corresponding cavity 108.

The TPA member 104 in an embodiment includes a first cavity wall 214 and a second cavity wall 216. The cavity walls 214, 216 extend generally parallel to each other and are connected to each other by first and second end walls 218, 220 at the ends of the TPA member 104 and bridge walls 222 that are disposed between the end walls 218, 220. The end walls 218, 220 may be mirror images of each other. As shown in FIG. 3A, the first cavity wall 214 of the TPA member 104 defines portions of the cavities 108 that hold the first row 204 of terminals 106. For example, the first cavity wall 214 defines a first portion of a perimeter of each of the cavities 108 in the first row 204, and, although not shown in FIG. 3A due to the cross-section, the housing 102 defines a second portion of the perimeter.

The first cavity wall 214 includes ledges 224 that project from the first cavity wall 214. When the TPA member 104 is in the locked position, the ledges 224 project beyond the interior walls 212 of the housing 102 into the cavities 108. With reference to FIG. 3B, the TPA member 104 may include two ledges 224 that extend into each of the cavities 108. The housing 102 may include shoulders 226 within each of the cavities 108 at an interface between a narrow segment 228 of the cavity 108 and a broad segment 230 of the cavity 108. The narrow segment 228 is defined entirely by the housing 102, and may be referred to herein as a unitary cavity segment 228. The broad segment 230 is defined by both the first cavity wall 214 of the TPA member 104 and the housing 102, and may be referred to herein as a hybrid cavity segment 230.

Figure 10:
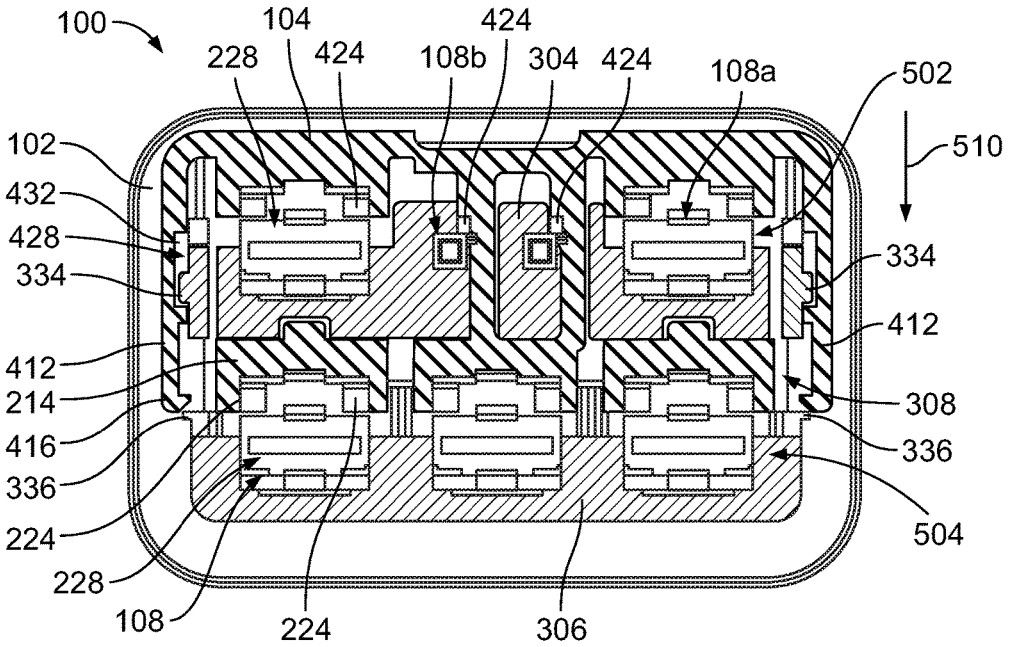
FIG. 10 is a cross-sectional plan view of the electrical connector showing the TPA member in the unlocked position on the housing according to an embodiment.

In an embodiment, the first cavity wall 214 is disposed on the shoulders 226. The ledges 224 project from the shoulders 226 into the cavity 108 (when the TPA member 104 is in the locked position). The ledges 224 extend into a retreat path 232 of the terminal 106 to block the terminal 106 from being pulled or pushed out of position towards the cable end 112. The retreat path 232 represents the footprint or cross-sectional area occupied by the terminal 106. For example, the ledges 224 may extend into a space behind the shroud 144, such that the back end 234 of the shroud 144 is configured to abut end surfaces 236 of the ledges 224 when the terminal 106 to block movement of the terminal 106 towards the cable end 112. In an embodiment, the ledges 224 may not extend into the retreat path 232 of the terminal 106 when the TPA member 104 is in the unlocked position (as shown in FIG. 10), which allows for loading and unloading of the terminals 106 relative to the housing 102.

In the illustrated embodiment, the TPA member 104 provides secondary retention of the terminals 106 within the cavities 108. For example, as shown in FIG. 3B, the shroud 144 includes a deflectable finger 240 that engages a lip 242 of the housing 102 to provide primary retention of the terminal 106 within the cavity 108. Due to size limitations of the finger 240 or improper usage, the deflectable finger 240 may not be able to withstand the forces exerted on the terminal 106 or the cable 110 attached to the terminal 106.

Thus, the TPA member 104 may provide additional support for the deflectable finger 140 to retain the terminal 106 in the proper position.

Figure 4A:
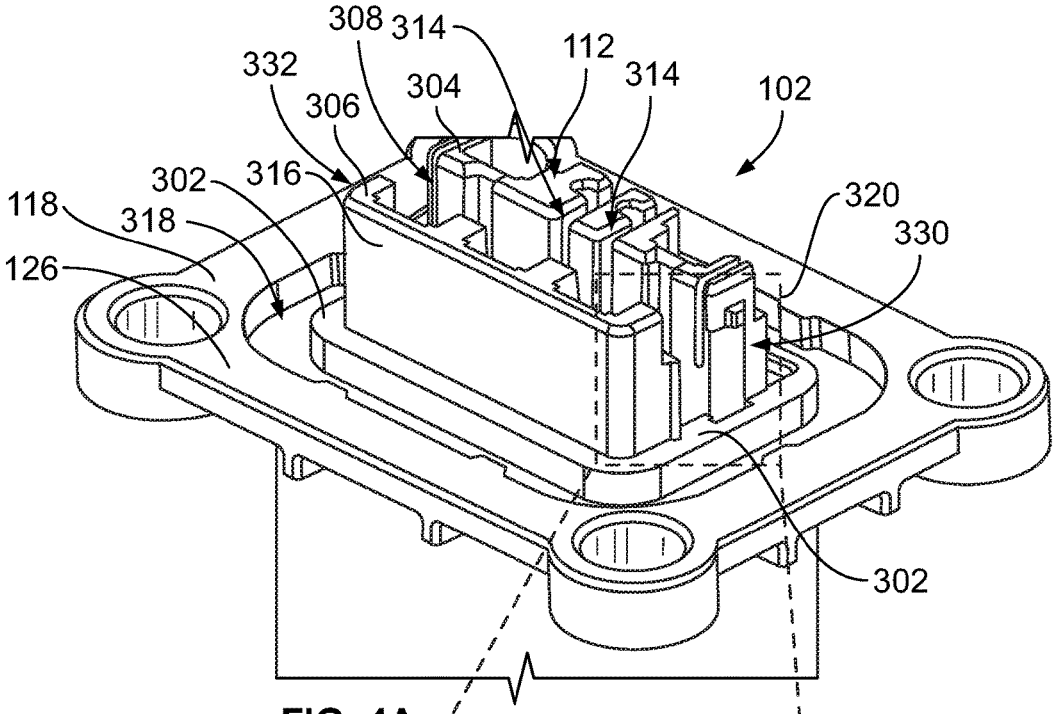
FIG. 4A is a perspective view of a portion of the housing at a cable end thereof according to an embodiment.

FIG. 4A is a perspective view of a portion of the housing 102 at the cable end 112 according to an embodiment. The housing 102 includes a base surface 302 and first and second platforms 304, 306 that extend from the base surface 302 to the cable end 112. The first and second platforms 304, 306 may define or represent the cable end 112 of the housing 102. The base surface 302 optionally may align with the mounting flange 118. For example, the base surface 302 may be co-planar with the first side 126 of the mounting flange 118, and the first and second platforms 304, 306 represent the portion of the housing 102 between the mounting flange 118 and the cable end 112.

The first and second platforms 304, 306 are contoured projections. The contours of the platforms 304, 306 are configured to complement contours of the TPA member 104 (shown in FIG. 3A). For example, the first platform 304 may include two gaps 314 that fragment or divide the first platform 304. The gaps 314 are each configured to receive a corresponding one of the bridge walls 222 (shown in FIG. 3A) of the TPA member 104 when the TPA member 104 is mounted on the housing 102. The second platform 306 may have a unitary construction that is not fragmented. The second platform 306 may include a planar outer surface 316 along the length of the second platform 306. The outer surface 316 faces away from the first platform 304.

In an embodiment, the first platform 304 is spaced apart from the second platform 306 by a trench 308. The trench 308 extends the entire depth of the platforms 304, 306 from the cable end 112 to the base surface 302 in the illustrated embodiment, but may extend only part of the depth in an alternative embodiment. The trench 308 is elongated along a length of the housing 102, and the first and second platforms 304, 306 extend parallel to each other along the length of the trench 308. For example, the platforms 304, 306 are elongated on either side of the trench 308 between a first end 330 of the platforms 304, 306 and an opposite, second end 332 of the platforms 304, 306.

Optionally, the mounting flange 118 may define a recess or trough 318 along the first side 126 that is configured to receive the compression seal 136 (shown in FIG. 1) therein. The trough 318 extends circumferentially around both the first and second platforms 304, 306 collectively. The compression seal 136 may be secured within the trough 318 via an adhesive or an interference fit with the edges of the trough 318.

Figure 4B:
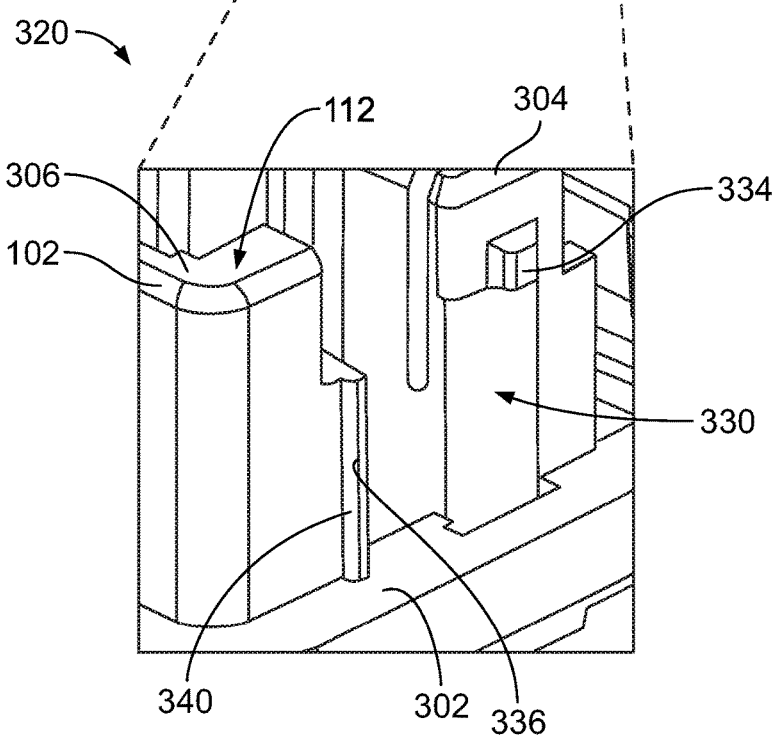
FIG. 4B is an enlarged view of a sub-section of the housing shown in FIG. 4A.

FIG. 4B is an enlarged view of a sub-section 320 of the housing 102 shown in FIG. 4A. At least one of the platforms 304, 306 includes features for connecting and retaining the TPA member 104 (shown in FIG. 3A) on the housing 102. In an embodiment, the features are disposed at the first and second ends 330, 332 of the platforms 304, 306, although only the first end 330 is visible in FIG. 4B. The features may include a mounting tab 334 and a locking rib 336. Both the mounting tab 334 and the locking rib 336 project radially outward from the first end 330 of the platforms 304, 306. In the illustrated embodiment, the first platform 304 includes the mounting tab 334, and the second platform 306 includes the locking rib 336. As described in more detail herein, the mounting tab 334 is configured to support alignment of the TPA member 104 relative to the housing 102 as the TPA member 104 is mounted to the housing 102. The mounting tab 334 may also support retention of the TPA member 104 on the housing 102, such that the TPA member 104 does not slide off of the platforms 304, 306 at the cable end 112 of the housing 102. The locking rib 336 may be configured to support securing the TPA member 104 in the locked position, and optionally may be used to prevent the TPA member 104 from inadvertently moving from the unlocked position to the locked position prematurely (e.g., before the terminals 106, shown in FIG. 2, are loaded into the housing 102). The locking rib 336 on the second platform 306 includes a catch surface 340 that faces away from the first platform 304.

In the illustrated embodiment, the locking rib 336 is disposed between the base surface 302 and the mounting tab 334 along a height of the platforms 304, 306 measured from the base surface 302 to the cable end 112. In one or more alternative embodiments, the mounting tab 334 and the locking rib 336 may be disposed at similar or overlapping positions along the height of the platforms 304, 306, or the mounting tab 334 may be disposed between the base surface 302 and the locking rib 336 along the height.

Although not shown in FIG. 4A or 4B, the platforms 304, 306 may include another mounting tab 334 and another locking rib 336 at the second end 332 of the platforms 304, 306 that mirror the mounting tab 334 and the locking rib 336 at the first end 330.

Figure 5:
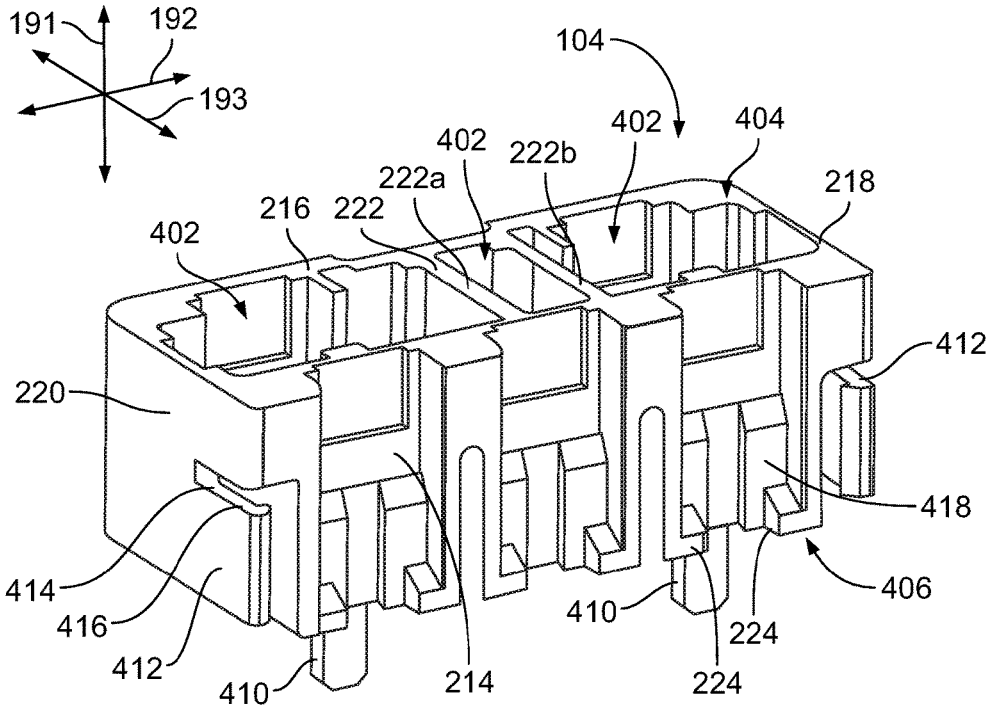
FIG. 5 is a perspective view of a TPA member of the electrical connector according to an embodiment.

FIG. 5 is a perspective view of the TPA member 104 of the electrical connector 100 (shown in FIG. 1) according to an embodiment. The TPA member 104 includes multiple walls, including the first cavity wall 214, the second cavity wall 216, the first and second end walls 218, 220, and the two bridge walls 222. The bridge walls 222 are located between the end walls 218, 220, and each bridge wall 222 connects to both cavity walls 214, 216. For example, the bridge walls 222 extend parallel to the end walls 218, 220. In an embodiment, the TPA member 104 is hollow, defining voids 402 between the walls 214, 216, 218, 220, 222. The TPA member 104 includes two bridge walls 222*a*, 222*b* in the illustrated embodiment, such that the TPA member 104 defines three voids 402 (e.g., one between the two bridge walls 222*a*, 222*b* and one on either side of the bridge walls 222*a*, 222*b*). In other embodiments, the TPA member 104 may have no bridge walls 222, one bridge wall 222, or more than two bridge walls 222.

The TPA member 104 includes a top end 404 and a bottom end 406 that is opposite to the top end 404. As used herein, relative or spatial terms such as "top," "bottom," "upper," "lower," "front," and "rear" are only used to distinguish the referenced elements in the illustrated orientation and do not necessarily require particular positions or orientations in the surrounding environment of the TPA member 104 or the electrical connector 100. The top end 404 may be proximate to, and optionally aligns with, the cable end 112 (shown in FIG. 3A) of the housing 102 when the TPA member 104 is mounted to the housing 102. The bottom end 406 may face towards the mating end 114 (FIG. 1) of the connector 100. In an embodiment, the TPA member 104 is open along the top end 404 and the bottom end 406, such that the voids 402 extend through the height of the TPA member 104. The ledges 224 of the first cavity wall 214 are disposed at the bottom end 406 in the illustrated embodiment, but may be spaced apart from the bottom end 406 in other embodiments. The ledges 224 are disposed along an outer surface 418 of the first cavity wall 214 that faces away from the voids 402 and the second cavity wall 216.

The TPA member 104 is oriented with respect to a vertical or elevation axis 191, a lateral axis 192, and a longitudinal or depth axis 193. The axes 191-193 are mutually perpendicular. Although the vertical axis 191 appears to extend generally parallel to gravity, it is understood that the axes 191-193 are not required to have any particular orientation with respect to gravity.

In an embodiment, the TPA member 104 includes at least one alignment post 410 projecting along the vertical axis 191 beyond the bottom end 406. The TPA member 104 includes two alignment posts 410 in the illustrated embodiment, but may have more or less than two in other embodiments. When the TPA member 104 is angularly positioned for mounting to the housing 102 (FIG. 1), the vertical axis 191 of the TPA member 104 is coaxial with the cavity axis 120 (FIG. 1), such that the alignment posts 410 extend parallel to the cavity axis 120.

The TPA member 104 also includes at least one deflectable latch arm 412 configured to engage one of the locking ribs 336 (FIG. 4B) of the housing 102 to secure the TPA member 104 in the locked position. In the illustrated embodiment, the TPA member 104 includes two latch arms 412, with one latch arm 412 located at the first end wall 218 and the other latch arm located at the second end wall 220. The latch arms 412 are each cantilevered between a respective fixed end 414 and a distal hook end 416, which is movable relative to the TPA member 104. In the illustrated embodiment, the two latch arms 412 extend along the longitudinal axis 193 from the fixed end 414 to the distal hook end 416. When the TPA member 104 is mounted to the housing 102, the latch arms 412 extend parallel to the actuation axis 134 (shown in FIG. 1). The latch arms 412 extend from the fixed ends 414 to the distal hook ends 416 in a direction towards the first cavity wall 214 of the TPA member 104. For example, the fixed ends 414 are located between the second cavity wall 216 and the distal hook ends 416 along the longitudinal axis 193. The distal hook ends 416 may align with, or may be located proximate to, the first cavity wall 214.

Figure 6:
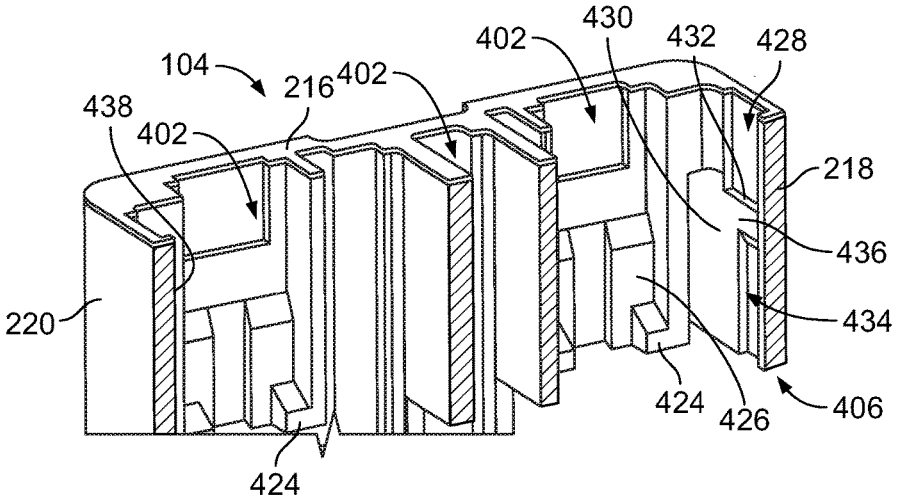
FIG. 6 is a cross-sectional view of the TPA member according to the embodiment shown in FIG. 5.

FIG. 6 is a cross-sectional view of the TPA member 104 according to the embodiment shown in FIG. 5. The cross-section line extends parallel to the lateral axis 192 shown in FIG. 5, cutting out the first cavity wall 214 to show the interior of the voids 402 and the second cavity wall 216. As shown in FIG. 6, the second cavity wall 216 includes ledges 424 that are sized and shaped like the ledges 224 (shown in FIG. 5) of the first cavity wall 214. The ledges 424 are disposed along an inner surface 426 of the second cavity wall 216 that faces towards the first cavity wall 214 and defines a portion of the voids 402. The ledges 424 project from the inner surface 426 into the voids 402. The ledges 424 of the second cavity wall 216 project in the same direction as the ledges 224 of the first cavity wall 214. For example, the ledges 224 project away from the voids 402, as shown in FIG. 5.

In an embodiment, the first end wall 218 of the TPA member 104 defines a recess 428 along an inner surface 430 thereof that faces the voids 402. A bottom end of the recess 428 is defined by a shelf 432 of the first end wall 218. The shelf 432 has a length elongated along the longitudinal axis 193 (FIG. 5). When the TPA member 104 is mounted to the housing 102 (shown in FIG. 4A), the mounting tab 334 (FIG. 4B) along the first end 330 of the platforms 304, 306 is received within the recess 428 of the first end wall 218. The recess 428 is wider than the mounting tab 334 along the longitudinal axis 193 to allow for relative movement between the TPA member 104 and the housing 102 while retaining the TPA member 104 on the housing 102. For example, the mounting tab 334 within the recess 428 may slide along the shelf 432 as the TPA member 104 moves along the actuation axis 134 (FIG. 1) relative to the housing 102.

The first end wall 218 may also define a guide slot 434 along the inner surface 430. The guide slot 434 is elongated along the vertical axis 191 (FIG. 5), and extends from the bottom end 406 of the TPA member 104. The guide slot 434 aligns with the recess 428, such that the guide slot 434 is disposed vertically below the recess 428 (e.g., between the recess 428 and the bottom end 406). An upper end of the guide slot 434 is spaced apart from the recess 428 by a ridge 436 of the first end wall 218. The shelf 432 of the recess 428 is a top surface of the ridge 436. In an embodiment, the guide slot 434 receives the mounting tab 334 (shown in FIG. 4B) of the housing 102 therein during the mounting of the TPA member 104 to the housing 102. For example, the mounting tab 334 is received within the guide slot 434 at the bottom end 406 and slides upward within the guide slot 434 as the TPA member 104 is loaded onto the first platform 304 (FIG. 4B) of the housing 102. Eventually the mounting tab 334 abuts the ridge 436 at the upper end of the guide slot 434. The ridge 436 resists, but does not block, additional movement of the TPA member 104 in the loading direction 130 (FIG. 2), as the ridge 436 deflects around the mounting tab 334 of the housing 102 with sufficient force exerted on the TPA member 104 in the loading direction 130. The mounting tab 334 enters the recess 428 upon the shelf 432 of the ridge 436 passing beyond the mounting tab 334.

In an embodiment, the guide slot 434 is narrower than the recess 428 along the longitudinal axis 193, and the guide slot 434 is not centered with the recess 428. The guide slot 434 aligns with a portion of the recess 428 located more proximate to the first cavity wall 214 (FIG. 5) than to the second cavity wall 216. The shape and position of the guide slot 434 may be configured to ensure that the TPA member 104 attains the unlocked position upon being mounted to the housing 102, thus preventing the TPA member 104 from being loaded directly into the locked position.

Although not shown in FIG. 6, the second end wall 220 of the TPA member 104 mirrors the first end wall 218 in an embodiment. For example, an inner surface 438 of the second end wall 220 (which faces the voids 402) may also include a recess, a ridge with a shelf, and a guide slot that are identical, or at least similar, to the recess 428, ridge 436, and guide slot 434 of the first end wall 218.

Figure 7:
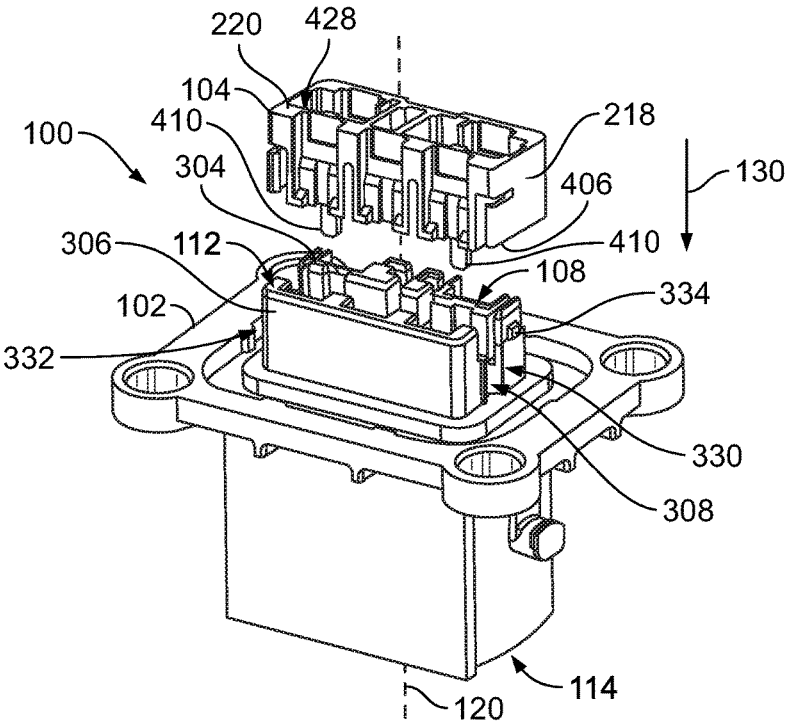
FIG. 7 is a perspective view of the TPA member poised for mounting to the housing according to an embodiment.
Figure 8:
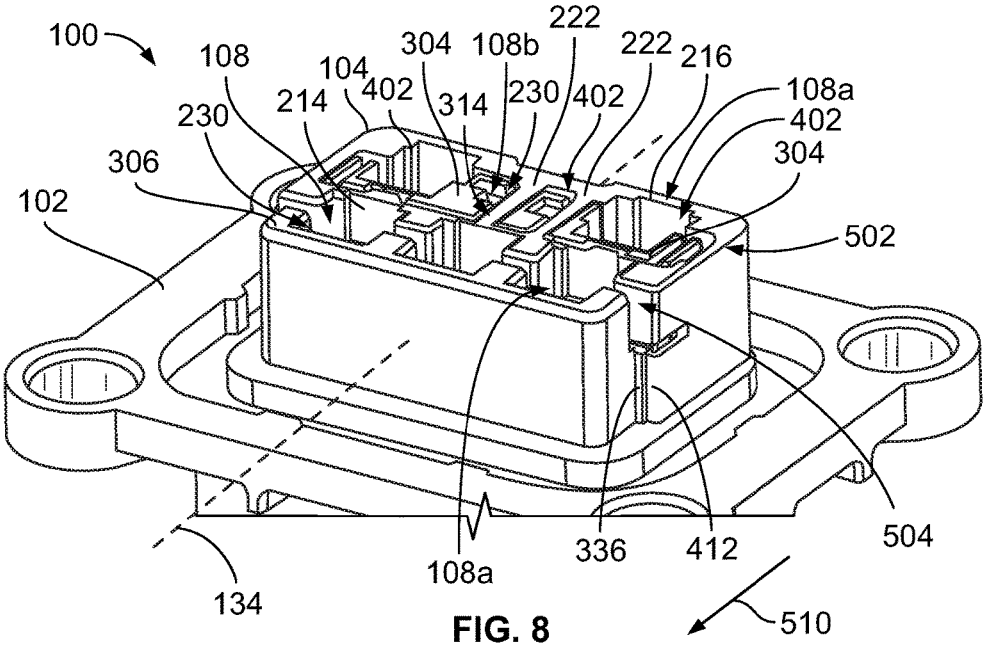
FIG. 8 is a perspective view of the electrical connector showing the TPA member mounted to the housing in an unlocked position according to an embodiment.
Figure 9:
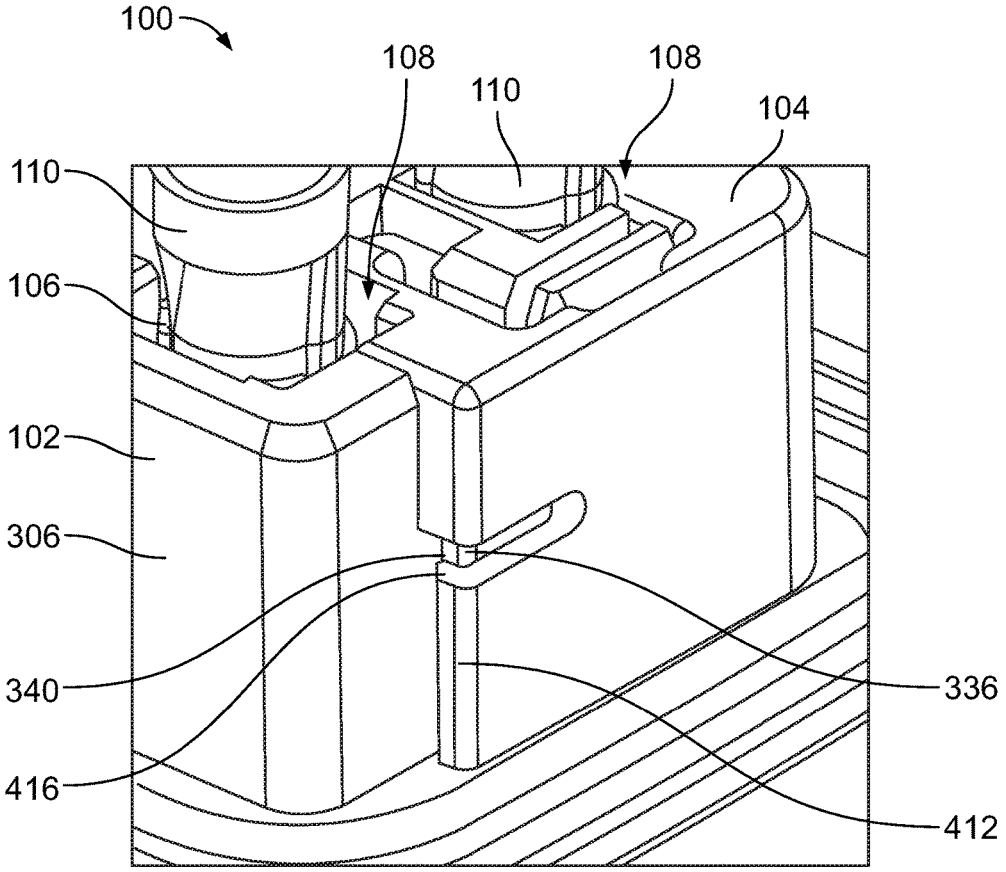
FIG. 9 is a close-up perspective view of the electrical connector showing the TPA member mounted to the housing in a locked position according to an embodiment.

FIGS. 7-9 illustrate an assembly process of the electrical connector 100 according to an embodiment, including the mounting and actuation of the TPA member 104 relative to the housing 102. For example, FIG. 7 is a perspective view of the TPA member 104 poised for mounting to the housing 102 according to an embodiment. The TPA member 104 mounts to the cable end 112 of the housing 102 by moving the TPA member 104 in the loading direction 130 parallel to the cavity axis 120 of the housing 102. The TPA member 104 is oriented such that the bottom end 406 faces towards the mating end 114 of the housing 102. As the TPA member 104 is loaded onto the housing 102, the alignment posts 410 that project beyond the bottom end 406 are received into the trench 308 between the first and second platforms 304, 306 of the housing 102. The alignment posts 410 may extend into corresponding guide openings (not shown) between cavities 108 of the housing 102. Furthermore, the mounting tabs 334 at the first and second ends 330, 332 of the platforms 304, 306 are received into the corresponding guide slots 434 (FIG. 6) in the first and second end walls 218, 220 of the TPA member 104. The TPA member 104 is fully loaded to the housing 102 upon the mounting tabs 334 entering the recesses 428 (FIG. 6) of the end walls 218, 220.

FIG. 8 is a perspective view of the electrical connector 100 showing the TPA member 104 mounted to the housing 102 in the unlocked position according to an embodiment. In the illustrated embodiment, the TPA member 104 extends into the trench 308 (shown in FIG. 7) and circumferentially surrounds the first platform 304 of the housing 102 when the TPA member 104 is mounted to the housing 102. For example, the fragmented first platform 304 is received within the voids 402 of the TPA member 104. The bridge walls 222 of the TPA member 104 are received into the gaps 314 in the first platform 304.

In an embodiment, the TPA member 104 and the platforms 304, 306 of the housing 102 collectively define the broad or hybrid cavity segments 230 of the cavities 108. For example, the TPA member 104 defines a portion of the perimeter of each of the hybrid cavity segments 230, and a corresponding one of the platforms 304, 306 of the housing 102 defines a remaining portion of the perimeter. In the illustrated embodiment, the connector 100 includes two rows 502, 504 of cavities 108, but may have more or less than two rows in other embodiments. The first platform 304 of the housing 102 defines portions of the cavities 108 in the first row 502, and the second platform 306 defines portions of the cavities 108 in the second row 504.

For example, the hybrid cavity segments 230 of two power cavities 108*a* in the first row 502 are defined by the first platform 304 of the housing 102 and the second cavity wall 216 of the TPA member 104. The power cavities 108*a* are configured to receive the power terminals 106*a* (shown in FIG. 2). The first row 502 also includes two signal cavities 108*b* that are configured to receive the signal terminals 106*b* (FIG. 2). The signal cavities 108*b* may be smaller than the power cavities 108*a*. In the illustrated embodiment, the hybrid cavities segments 230 of the signal cavities 108*b* are defined by the first platform 304 and the bridge walls 222 of the TPA member 104. The second row 504 of the cavities 108 in the illustrated embodiment has three power cavities 108*a*, and the hybrid cavity segments 230 thereof are defined by the second platform 306 of the housing 102 and the first cavity wall 214.

In the unlocked position of the TPA member 104, the connector 100 is configured to enable the insertion of the terminals 106 (FIG. 2) into the cavities 108. As shown in FIG. 8, the visible latch arm 412 of the TPA member 104 is not latched to the locking rib 336 on the second platform 306 of the housing 102. Once the terminals 106 are loaded into the cavities 108, the TPA member 104 may be actuated to move from the unlocked position to the locked position. The TPA member 104 is moved from the unlocked position in a locking direction 510 along the actuation axis 134 to the locked position. The movement in the locking direction 510 may be perpendicular to the movement in the loading direction 130 along the cavity axis 120 (FIG. 7). The TPA member 104 may move towards the second platform 306 of the housing 102 as the TPA member 104 moves in the locking direction 510.

FIG. 9 is a close-up perspective view of the electrical connector 100 showing the TPA member 104 mounted to the housing 102 in the locked position according to an embodiment. In the illustrated embodiment, the terminals 106 and the associated cables 110 are within the corresponding cavities 108 of the connector 100. In the locked position, the distal hook end 416 of the latch arm 412 engages and latches to the catch surface 340 of the locking rib 336 on the second platform 306 of the housing 102. The engagement between the latch arm 412 and the locking rib 336 may secure the TPA member 104 in the locked position, blocking reverse movement of the TPA member 104 towards the unlocked position relative to the housing 102.

FIG. 10 is a cross-sectional plan view of the electrical connector 100 showing the TPA member 104 in the unlocked position on the housing 102 according to an embodiment. The two rows 502, 504 of cavities 108 are visible in FIG. 10, including both the power cavities 108*a* and the signal cavities 108*b*. The first cavity wall 214 of the TPA member 104 is disposed within the trench 308 of the housing 102 between the first and second platforms 304, 306.

When the TPA member 104 is in the unlocked position, as shown in FIG. 10, the ledges 224, 424 of the TPA member 104 do not extend into retreat paths 232 (shown in FIG. 3B) of the terminals 106 (FIG. 3B). Optionally, the ledges 224, 424 may be recessed laterally from the narrow segments 228 of the cavities 108, which are entirely defined by the housing 102, such that the ledges 224, 424 do not project into the cavities 108. Since the TPA member 104 is mounted to the housing 102, the mounting tabs 334 are received within the corresponding recesses 428 of the TPA member 104, and may engage the shelves 432. The latch arms 412 of the TPA member 104 are not connected to the corresponding locking ribs 336. In an embodiment, the distal hook ends 416 of the latch arms 412 may be configured to abut against the locking ribs 336 to prohibit the TPA member 104 from unintentional movement along the locking direction 510 to the locking position.

Figure 11:
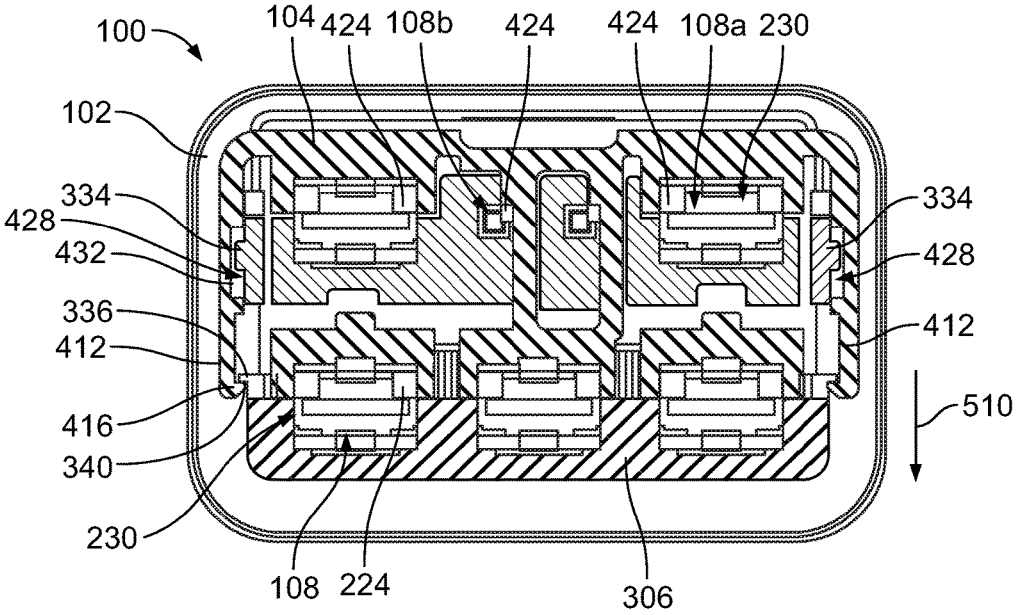
FIG. 11 is a cross-sectional plan view of the electrical connector showing the TPA member in the locked position on the housing according to an embodiment.

FIG. 11 is a cross-sectional plan view of the electrical connector 100 showing the TPA member 104 in the locked position on the housing 102 according to an embodiment. The terminals 106 (shown in FIG. 2) are not shown in FIG. 11, although the terminals 106 would be loaded into the cavities 108 prior to actuating the TPA member 104. Compared to FIG. 10, the only change is the position of the TPA member 104 relative to the housing 102, such that the TPA member 104 is shifted towards the second platform 306 of the housing 102. As the TPA member 104 is actuated in the locking direction 510, the mounting tabs 334 may slide along the shelves 432 within the recesses 428. The distal hook ends 416 of the latch arms 412 initially deflect around the locking ribs 336 and subsequently latch onto the catch surfaces 340 to secure the TPA member 104 in the locked position.

As shown in FIG. 11, due to the relative movement of the TPA member 104, the cross-sectional areas of the cavities 108 along the hybrid or broad segments 230 are altered. Specifically, the movement to the locked position has reduced the cross-sectional areas of the hybrid segments 230 of the cavities 108. The ledges 224, 424 of the TPA member 104 extend into the cavities 108, including both the power cavities 108*a* and the signal cavities 108*b*. The ledges 224, 424 extend into the retreat paths 232 to block retreat of the terminals 106, as described with reference to FIG. 3B.

Figure 12:
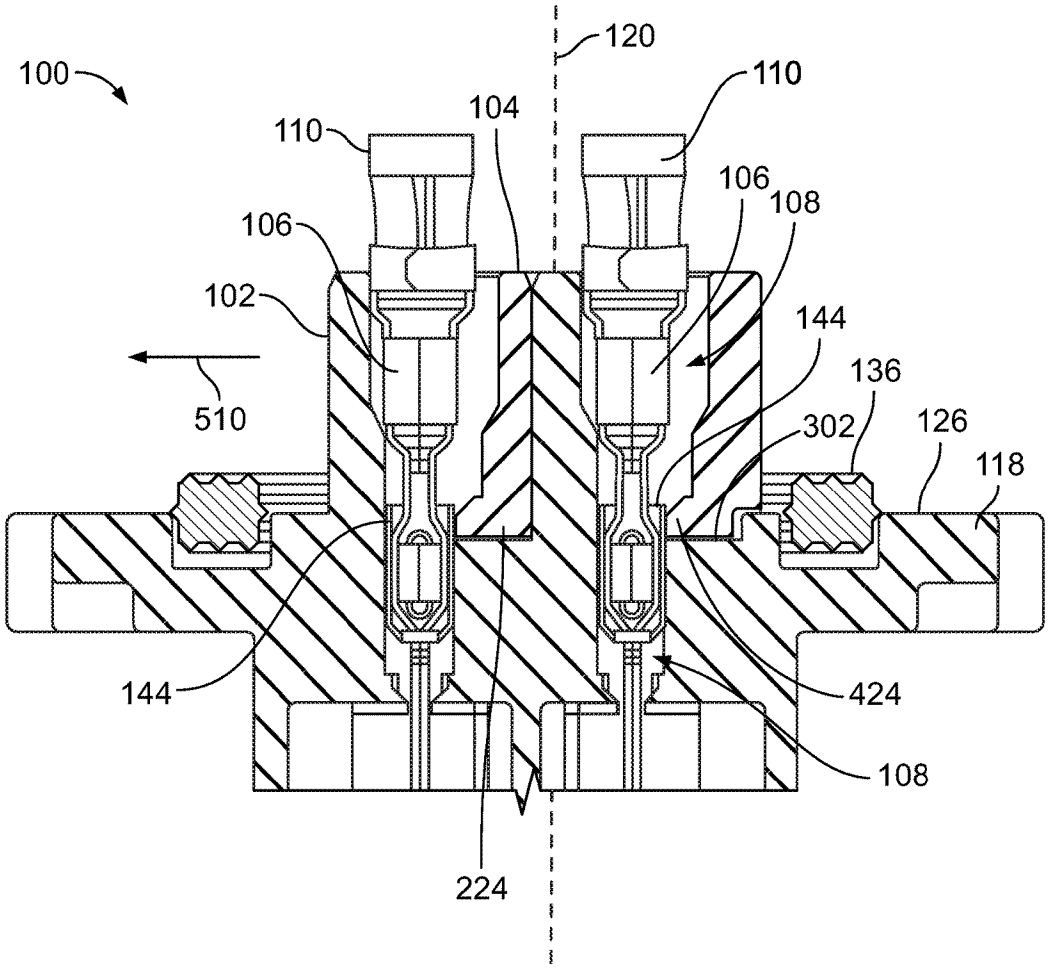
FIG. 12 is a side cross-sectional view of the electrical connector according to an embodiment.

FIG. 12 is a side cross-sectional view of the electrical connector 100 according to an embodiment. The TPA member 104 is shown in the unlocked position on the housing 102. The ledges 224, 424 of the TPA member 104 may be disposed on the base surface 302 of the housing 102. In the illustrated embodiment, the base surface 302 aligns with the mounting flange 118 of the housing 102. For example, the base surface 302 is recessed relative to the first side 126 of the mounting flange 118 and the compression seal 136. By loading the TPA member 104 parallel to the cavity axis 120, the TPA member 104 can reach the base surface 302 without interfering with the compression seal 136 or the mounting flange 118. By configuring the TPA member 104 to actuate in the locking direction 510 perpendicular to the cavity axis 120, the TPA member 104 may be able to withstand relatively large pull-out forces exerted on the terminals 106 and associated cables 110.

The illustrated embodiment shows two terminals 106 that are not fully loaded within the corresponding cavities 108 of the housing 102. Since the terminals 106 are not fully loaded, the TPA member 104 cannot be actuated in the locking direction 510 to the locked position. For example, the ledges 224, 424 would abut against the terminals 106 (e.g., the shrouds 144 of the terminals 106), blocking additional movement in the locking direction 510. The TPA member 104 provides terminal position assurance because the obstructed movement indicates to the user that at least one of the terminals 106 is not fully loaded.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing having a mating end and a cable end, the housing defining multiple cavities extending between the mating and cable ends that are oriented parallel to a cavity axis, the housing holding electrical terminals within the cavities for electrically connecting to mating contacts of a mating connector, wherein the housing includes a base surface and first and second platforms extending from the base surface to the cable end, the first and second platforms defining portions of the cavities, the first platform spaced apart from the second platform by a trench; and a terminal position assurance (TPA) member mounted to the cable end of the housing and movable relative to the housing between an unlocked position and a locked position, the TPA member extending through the trench and circumferentially surrounding the first platform, the TPA member moving from the unlocked position to the locked position along an actuation axis that is perpendicular to the cavity axis, the TPA member moving towards the second platform as the TPA member moves from the unlocked position to the locked position, the TPA member including ledges that protrude into the cavities of the housing and into corresponding retreat paths of the terminals when the TPA member is in the locked position to block retreat of the terminals towards the cable end of the housing.

2. The electrical connector of claim 1, wherein the ledges are spaced apart from the retreat paths of the terminals when the TPA member is in the unlocked position to allow loading and unloading of the terminals relative to the cavities.

3. The electrical connector of claim 1, wherein the TPA member includes a shelf that engages a tab of the housing to retain the TPA member on the housing, the shelf having a length that is elongated parallel to the actuation axis such that the tab slides along the length of the shelf as the TPA member is moved between the unlocked and locked positions relative to the housing.

4. The electrical connector of claim 1, wherein one or more of the cavities includes a hybrid cavity segment that extends from the cable end of the housing, the housing defining a first portion of a perimeter of the hybrid cavity segment and the TPA member defining a second portion of the perimeter of the hybrid cavity segment, wherein the movement of the TPA member between the unlocked position and the locked position alters a cross-sectional area of the hybrid cavity segment.

5. The electrical connector of claim 4, wherein the one or more of the cavities includes a unitary cavity segment extending from the hybrid cavity segment towards the mating end of the housing, the housing defining an entire perimeter of the unitary cavity segment, wherein the ledges of the TPA member are disposed at an interface between the unitary cavity segment and the hybrid cavity segment.

6. The electrical connector of claim 1, wherein the housing includes a main body that extends linearly between the mating end and the cable end, the housing including a mounting flange projecting radially from the main body, the mounting flange disposed between and spaced apart from the mating end and the cable end, the mounting flange configured for mounting the housing through an opening in a panel.

7. The electrical connector of claim 6, wherein the mounting flange includes a first side facing towards the cable end of the housing and a second side that faces towards the mating end, wherein the electrical connector includes a compression seal mounted to the first side of the mounting flange and extending circumferentially around the main body of the housing and the TPA member.

8. The electrical connector of claim 1, wherein the TPA member includes a deflectable latch arm extending parallel to the actuation axis from a fixed end to a distal hook end, the housing including a locking rib, the distal hook end of the latch arm engaging a catch surface of the locking rib when the TPA member is in the locked position to secure the TPA member in the locked position, wherein the distal hook end is spaced apart from the catch surface when the TPA member is in the unlocked position.

9. The electrical connector of claim 1, wherein the first platform includes a tab that engages a shelf of the TPA member in both the locked and unlocked positions to retain the TPA member on the housing, the second platform including a locking rib that is engaged by a deflectable latch arm of the TPA member when the TPA member is in the locked position to secure the TPA member in the locked position.

10. The electrical connector of claim 1, wherein the TPA member includes a top end and a bottom end, the top end aligning generally with the cable end of the housing when the TPA member is mounted to the housing, the bottom end facing towards the mating end of the housing, the TPA member including at least one alignment post projecting beyond the bottom end parallel to the cavity axis and received between the cavities of the housing.

11. The electrical connector of claim 1, wherein the housing includes a mounting tab and the TPA member includes a bottom end that faces towards the mating end of the housing, the TPA member defining a guide slot that extends from the bottom end is elongated parallel to the cavity axis, wherein the mounting tab of the housing is received in and slides relative to guide slot as the TPA member is mounted to the housing in a loading direction parallel to the cavity axis.

12. An electrical connector comprising:

a housing having a mating end and a cable end, the housing defining multiple cavities extending between the mating and cable ends and oriented parallel to a cavity axis, the housing holding electrical terminals within the cavities for electrically connecting to mating contacts of a mating connector, the housing including a mounting tab; and a terminal position assurance (TPA) member mounted to the cable end of the housing and movable relative to the housing between an unlocked position and a locked position, the TPA member moving from the unlocked position to the locked position along an actuation axis that is perpendicular to the cavity axis, the TPA member including ledges that protrude into the cavities of the housing and into corresponding retreat paths of the terminals when the TPA member is in the locked position to block retreat of the terminals towards the cable end of the housing, wherein the TPA member includes a bottom end that faces towards the mating end of the housing, the TPA member defining a guide slot that extends from the bottom end and is elongated parallel to the cavity axis, wherein the mounting tab of the housing is received in and slides relative to the guide slot as the TPA member is mounted to the housing in a loading direction parallel to the cavity axis, wherein each of the cavities includes a respective hybrid cavity segment that extends from the cable end of the housing towards the mating end, wherein the housing defines a portion of a perimeter of the hybrid cavity segment and the TPA member defines a remaining portion of the perimeter of the hybrid cavity segment, wherein the movement of the TPA member between the unlocked and locked positions alters a cross-sectional area of the hybrid cavity segment of each of the cavities.

13. The electrical connector of claim 12, wherein the ledges are spaced apart from the retreat paths of the terminals when the TPA member is in the unlocked position to allow loading and unloading of the terminals relative to the cavities.

14. The electrical connector of claim 12, wherein the housing includes a base surface and first and second platforms extending from the base surface to the cable end of the housing, the first and second platforms extending along the hybrid cavity segments of the cavities, the first platform spaced apart from the second platform by a trench, the TPA member extending through the trench and circumferentially surrounding the first platform, wherein the TPA member moves towards the second platform as the TPA member moves from the unlocked position to the locked position.

15. The electrical connector of claim 14, wherein the ledges of the TPA member move along the base surface of the housing, the base surface aligning with a mounting flange of the housing that projects radially from the base surface for mounting the housing through an opening in a panel, the first and second platforms extending from the mounting flange to the cable end.

16. The electrical connector of claim 14, wherein the cavities of the housing are arranged in two rows located on opposite sides of the trench, the first platform defining portions of the cavities in one of the two rows, the second platform defining portions of the cavities in the other of the two rows.

17. An electrical connector comprising:

a housing including a main body and a mounting flange configured for mounting the housing through an opening in a panel, the main body extending linearly between a mating end of the housing and a cable end of the housing, the main body defining multiple cavities between the mating and cable ends that are oriented parallel to a cavity axis, the housing holding electrical terminals within the cavities for electrically connecting to mating contacts of a mating connector, the mounting flange projecting radially from the main body, the mounting flange disposed between and spaced apart from the mating end and the cable end; and a terminal position assurance (TPA) member mounted to the cable end of the housing, the TPA member being movable relative to the housing between an unlocked position and a locked position along an actuation axis that is perpendicular to the cavity axis, the TPA member including ledges that protrude into the cavities of the housing and into corresponding retreat paths of the terminals when the TPA member is in the locked position to block retreat of the terminals towards the cable end of the housing, wherein the portion of the main body that extends from the mounting flange to the cable end is defined by a first platform and a second platform that are spaced apart from each other by a trench, the TPA member extending through the trench and circumferentially surrounding the first platform, wherein the TPA member moves towards the second platform as the TPA member moves from the unlocked position to the locked position.

18. The electrical connector of claim 17, wherein the mounting flange includes a first side facing towards the cable end of the housing and a second side that faces towards the mating end, wherein the electrical connector includes a compression seal mounted to the first side of the mounting flange, the compression seal extending circumferentially around the main body of the housing and the TPA member, wherein the compression seal is coplanar with at least a portion of the TPA member.

* * * * *